US005106044A

United States Patent [19]

Regard, III et al.

[11] Patent Number: 5,106,044

[45] Date of Patent: Apr. 21, 1992

[54] PORTABLE COMPOUND BOW STAND

[76] Inventors: Joseph T. Regard, III, 34 Shady Oaks, Covington, La. 70433; Peter W. Snyder, 307 Simpson Pl., Hammond, La. 70401

[21] Appl. No.: 635,761

[22] Filed: Dec. 26, 1990

[51] Int. Cl.[5] ..... F41B 5/00

[52] U.S. Cl. ..... 248/169; 248/309.1; 248/229; 124/23.1

[58] Field of Search ..... 248/169, 156, 309.1, 248/229; 124/23.1

[56] References Cited

U.S. PATENT DOCUMENTS

| | | | |
|---|---|---|---|
| 2,942,830 | 6/1960 | Senay | 248/229 X |
| 3,256,872 | 6/1966 | Koser | 124/23.1 |
| 4,628,893 | 12/1986 | Shaw, III | 124/23.1 |
| 4,674,472 | 6/1987 | Reis | 124/23.1 X |
| 4,846,140 | 7/1989 | DiMartino | 248/156 X |
| 4,974,575 | 12/1990 | Mitchell | 124/23.1 X |
| 4,993,398 | 2/1991 | Wallace | 124/23.1 |

FOREIGN PATENT DOCUMENTS 1109676 4/1968 United Kingdom ..... 248/169

*Primary Examiner*—Alvin C. Chin-Shue

[57] ABSTRACT

An attachment to compound bows and the like for supporting it in a substantially vertical position relative the ground, allowing easy display or quick access, providing an effective support system for displaying or storing the bow in the home, hunting in the woods, or practicing in the field. The preferred embodiment of the present invention comprises a base plate which, in the principal embodiment is affixed to the stabilizer hole of the bow, hinged, elongated support legs affixed to the base plate, and a leg bracket which is affixed to the lower limb of the bow, the bracket configured to store the support legs in an out of the way position when the bow is in use. The present invention may also include a wrist strap affixed to the base plate to aim in the handling and aiming of the bow. The present invention is adaptable to be used with almost any bow on the market having a stabilizer hole, providing an inexpensive, effective, and convenient way to store, display, or otherwise stand a compound bow.

4 Claims, 1 Drawing Sheet

PORTABLE COMPOUND BOW STAND

BACKGROUND OF INVENTION

1. Field of Invention

The present invention relates to archery accessories and more particularly to a portable compound bow stand. The present invention comprises an attachment to compound bows and the like which allows them to stand in a substantially vertical position relative the ground, allowing easy display or quick access, a useful feature whether displaying or storing the bow in the home, hunting in the woods, or practicing in the field.

The preferred embodiment of the present invention comprises an accessory comprising a base plate which is affixed to the stabilizer hole of the bow, hinged, elongated support legs affixed to the base plate, and a leg bracket which is affixed to the lower limb of the bow, the bracket configured to store the support legs in an out of the way position when the bow is in use.

The present invention may also include a wrist strap affixed to the base plate to aid in the handling and aiming of the bow.

The present invention is adaptable to be used with almost any bow on the market having a stabilizer hole, providing an inexpensive, effective, and convenient way to store, display, or otherwise stand a compound bow.

2. Prior Art&General Background

Applicant knows of no prior art which teaches or otherwise contemplates a bow stand which is affixed to compound bows or the like.

The only prior art which applicant is aware comprises various "racks" which are independent the bow, for holding a bow against a wall or supporting on a deer stand.

For an example of a deer stand accessory comprising a bow support bracket affixed to the deer stand, see the "Unique Bowholder" by Unique Archery Products, Inc of Hartselle, Al.

Certainly, this prior art is fully distinguishable in apparatus and method from that contemplated by the present invention. Therefore, as for as applicant is aware, the prior art has yet failed to teach an accessory compound bow stand which is unobtrusively affixed to the bow itself, supporting it in a stable, vertical fashion, yet is able to be affixed to the bow in a "closed" position in such a manner as not to interfere with the use of the bow.

GENERAL, SUMMARY DISCUSSION OF THE INVENTION

The present invention provides a system for supporting a bow which is highly reliable, relatively economical and very cost effective, and unlike anything contemplated in the prior art.

The preferred embodiment of the present invention contemplates a bow stand which is designed to be compatible with a variety of bow configurations, yet provide a consistently stable, effective and unobtrusive means of supporting the bow when needed, while providing a position while not in use which does not interfere with the operation of the bow.

It is thus an object of the present invention to provide an accessory for bows and the like which is affixable to the bow itself in such a manner as not to interfere with the use of it, while supporting the bow in a substantially upright, vertical position when desired.

It is another object of the present invention to provide a bow stand which may be used with a variety of configuration and brand bows.

It is still another object of the present invention to provide a bow stand which is lightweight, easily installed and used, and inexpensive to manufacture.

It is still another object of the present invention to provide a portable bow stand which, when affixed to the bow, provides "standing" position and an unimposing "closed" position.

It is lastly an object of the present invention to provide a bow stand which may be used for storage as well as during target shooting or hunting, protecting the compound bow from dirt and moist ground.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENT(S)

Figure 1:
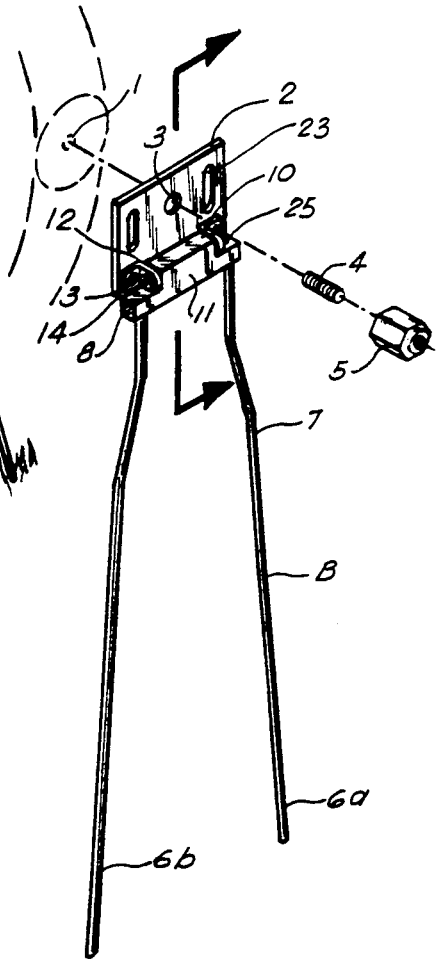
FIG. 1 is an isometric view of the preferred embodiment of the bowstand of the present invention further illustrating in phantom the bow to which it is applied, the stabilizer hole located therein, and installation nut and threaded piece.

As can be seen in FIG. 1, the bow stand of the preferred, exemplary embodiment of the present invention, comprises a base plate 2 having a mounting hole 3, and wrist strap apertures 23 therein. The exemplary embodiment of the present invention is formed entirely of aluminum, but it is noted that other materials light in weight yet strong, perform just as well. Such materials may include NYLONtm, high density polyurethane, and carbon fiber/epoxy composites all are believed to work well, and may even perform better under some circumstances. Aluminum has been used thus far as it is durable, relatively expensive, and easily worked into the desired form.

Base plate 2 further comprises a leg base 11 having upper 10 and lower 8 portions therein, which is mounted to the base plate via swivel brackets 12 mounted thereon. Swivel brackets 12 are mounted to the base plate via screw arrangement 13 and to leg base 11 via screw arrangement 14.

Figure 5:
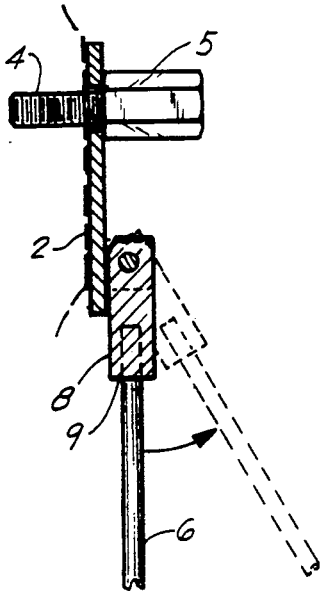
FIG. 5 is a side view of the bow stand of FIG. illustrating the pivotal action of the leg members relative the base plate, the extended image of the legs shown in phantom.

A pair of support legs *6a*, *6b* may be fictionally joined to the inner walls of apertures 9, 25 in leg base 11 by heating the base, thereby expanding the diameter of apertures 9, 25, enveloping the end of the legs with the inner walls of apertures 9, 25, and allowing the base to cool, thereby shrinking the diameter of the aperture, and forming a tight fit around the leg. This arrangement is more clearly set forth in FIG. 5 of the present drawings.

It is noted that other means of forming the base and legs, such as adhesives, welding, molding and the like, would work just as satisfactory as the above method and may be used interchangeably in manufacture with little appreciable difference in performance and quality, depending upon the material used.

Figure 4:
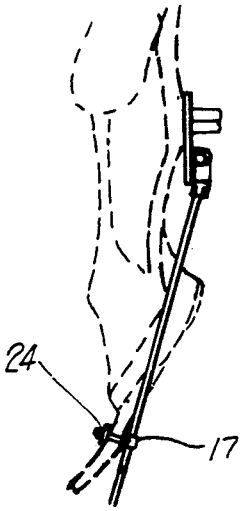
FIG. 4 is a side view of the bowstand of FIG. illustrating its placement relative an exemplary bow (in phantom).

Returning to FIG. 1 of the drawings, Legs 6*a*, 6*b* are configured to form a taper 7 in order to provide greater stability in the support position, but are formed of a flexible material so as to be brought closer together manually and supported by a lower leg bracket when in the closed position, thereby providing an unencumbering storage position. Further referring to FIG. 1, note that legs 6*a*, 6*b* emanate from the lower portion 8 of base 11 in a generally perpendicular fashion, wherein the legs are spaced closer relative one another near the base 29 area than at their ground contacting, distal ends 33. The tapers 7, formed by an upper, outwardly angled bend 30 relative the base, an obliquely running length 31, and a lower, inwardly angled bend 32 are formed to provide sufficient separation at the lower, distal 33 end of the legs where they contact the ground to provide stability, while allowing the legs to be drawn in to contact with the leg bracket 24 when the system is not in use, as shown in FIG. 4. This arrangement is superior to a straight leg configuration, which would require the legs to emanate from an oblique angle from the base to provide for wide separation for the legs at their distal ends. However, the straight leg configuration has two primary drawbacks: 1) there is offered a less stable support of the bow, as the upper portion of the legs would be spaced in a lesser fashion on another, and at a more awkward angle than that contemplated in the present invention; and 2) it becomes impractical to retract the legs against a leg bracket like 24 in FIG. 4, as the separation of a straight leg system would require the legs to bend too much to fit within the leg bracket 24, bending or breaking them.

Figure 2:
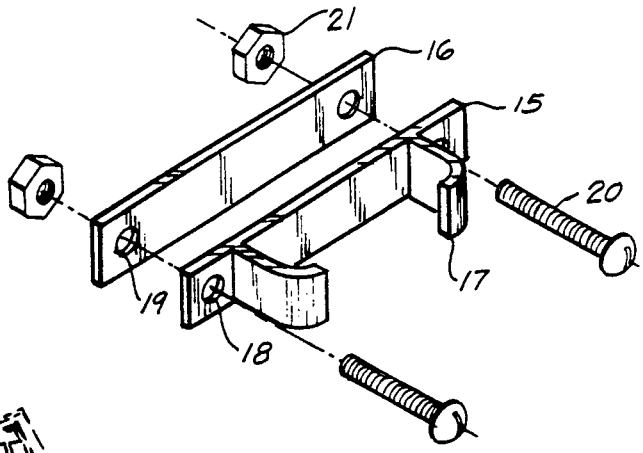
FIG. 2 is an isometric view of the leg bracket and hardware of the bowstand of FIG. 1.
Figure 6:
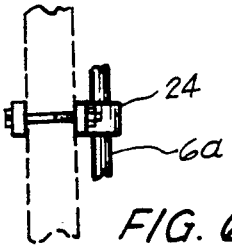
FIG. 6 is a side view of the leg bracket of FIG. 2 illustrating its placement relative the lower limb of an exemplary bow (in phantom).
Figure 3:
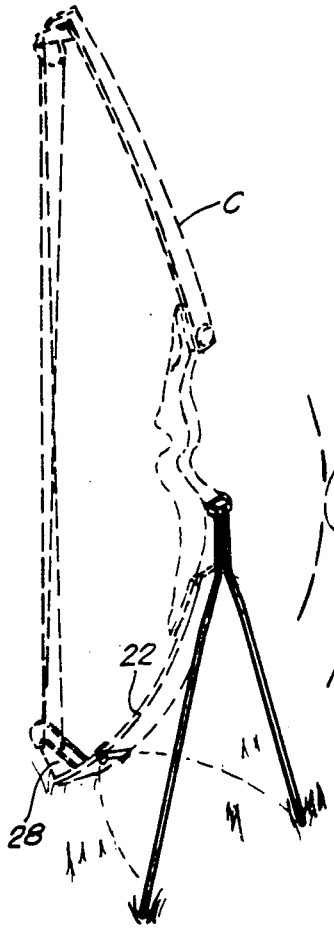
FIG. 3 is an isometric view of the bowstand and bracket of FIGS. 1 and 2, illustrating in phantom an exemplary bow and further showing the placement of the bow stand and bracket on the bow.

As shown in FIGS. 2, 3, and 4 of the drawings, the present invention utilizes a leg bracket 24 in order support legs 6*a*, 6*b* in the closed position. The leg bracket is formed of a main bracket 15 having radial tabs 17 emanating therefrom and mounting apertures 18 therein. Also utilized is back mounting plate 16 with mounting apertures 19, which are affixed about the lower limb 22 of the bow via nut 21 and bolt 20 arrangement, as shown in FIG. 6.

FIGS. 3 and 4 illustrate the present system in its open and closed positions, respectively. As shown in the drawings, the exemplary compound bow C is supported in a substantially upright and vertical position when the present system is in the open position. The phantom line in FIG. 3 illustrates the path of the lower leg portions as they are brought from the open to closed position and visa-versa. As shown in FIG. 4, the leg bracket 24 holds the lower leg portions in place. In mounting the legs into the closed position, the user manually pushes the lower leg portions toward one another, reducing the distance between them, as he directs the lower leg portions between the radial tabs 17 (as shown in FIG. 2) of the mounted leg bracket 24.

Opening the stand is simply a matter of directing the two lower leg members toward one another, while pivotally moving them away from the bow, thereafter relieving any pressure against the legs, allowing them to separate to their normal distance. Finally, the lower part of the bow is placed in vertical communication with the ground, and the legs situated to support same, as shown in FIG. 3. In order to protect the lower end portion of the bow 28, a cover plate may be provided with the present system. However, such a plate is not essential to the satisfactory operation of the present system.

In order to mount the present invention to the a bow, such as a compound bow with a stabilizer hole, the user merely aligns the stabilizer hole with the mounting aperture 3 of the base plate 2 (as shown in FIG. 1), and threads threaded member therethrough so that it threadingly engages the stabilizer hole 1 and passes through aperture 3, then engages nut 5 until it communicates with base plate 2. It is noted that other means of mounting the bow, such as straps, brackets, and the like, may also be used with similar satisfactory results.

Once the above is mounted, only the lower leg bracket remains, and may be mounted as earlier discussed.

The base plate is configured so as not to interfere with normal utilization of the bow when in its closed position, and may include a wrist strap or the like to further stabilize aim and use. Wrist strap holes 23 are therefore provided in the present embodiment for providing such an option.

The embodiment(s) described herein in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

We claim:

1. A portable bow stand having one and closed positions, for supporting a bow having an upper limb and a lower limb in a substantially vertical position relative the ground, comprising:

a base plate;

mounting means for mounting said base plate to said bow;

a leg bracket affixed to the lower limb of the bow;

first and second support members having a distal end and inner and outer areas, and configured to contact the ground when said stand is in the open position, said first and second support members further each having a taper formed therein, said taper comprising an upper, outwardly angled bend (30) relative the base, an obliquely running length (31), and a lower, inwardly angled bend (32), said taper configured to provide sufficient separation between said first and second support members at the lower, distal end (33) of the support members such that they contact the ground so as to provide stable support of the bow, while allowing the legs to be drawn in to communicate with the leg bracket (24) in a closed, unencumbering position; and pivotal mounting means for pivotally mounting said elongated support members to said base plate such that said first and second support members emanate from said pivotal mounting means in a somewhat transverse fashion.

2. The portable bow stand of claim 1, wherein support member comprises two leg members.

3. The portable bow stand of claim 1, wherein there is further included a leg bracket independent of said base plate, said leg bracket affixed to said lower limb of the bow, said leg bracket configured to engage said elongated support member.

4. The portable bow stand of claim 1, wherein said bow has a stabilizer hole, said base plate has a mounting aperture, and said base plate is mounted to said bow via threaded arrangement passing through said mounting aperture of said base plate, in threaded engagement with said stabilizer hole of said bow.

* * * * *